United States Patent [19]

Nakajima et al.

[11] Patent Number: 4,878,814

[45] Date of Patent: Nov. 7, 1989

[54] VARIABLE CAPACITY COMPRESSOR WITH CAPACITY-INDICATING DEVICE

[75] Inventors: Nobuyuki Nakajima; Kenichi Inomata; Masaya Moruta; Toshio Yamaguchi; Kazuo Eitai, all of Konan, Japan

[73] Assignee: Diesel Kiki Co., Ltd., Tokyo, Japan

[21] Appl. No.: 257,980

[22] Filed: Oct. 31, 1988

[30] Foreign Application Priority Data

Nov. 5, 1987 [JP] Japan ..... 62-280134

[51] Int. Cl.[4] ..... F04B 21/00; F04B 39/00; F04B 49/02

[52] U.S. Cl. ..... 417/63; 417/295; 417/310

[58] Field of Search ..... 417/63, 295, 310, 440

[56] References Cited

U.S. PATENT DOCUMENTS 3,515,496 6/1970 Eddy ..... 417/440

4,008,981 2/1977 Bouquet ..... 417/63

4,744,731 5/1988 Nakajima ..... 417/295

FOREIGN PATENT DOCUMENTS 55488 3/1987 Japan ..... 417/310

*Primary Examiner*—William L. Freeh

*Attorney, Agent, or Firm*—Charles S. McGuire

[57] ABSTRACT

A variable capacity compressor including a pumping device, and a control element the position of which can be changed to determine the capacity of the pumping device. The compressor comprises: a detector for detecting change in the position of the control element in a continuous manner; and a capacity-indicating device for visually indicating an output value thereof in a manner continuously variable in response to a continuous change in output from the detector, whereby the output value visually indicated by the capacity-indicating device varies continuously with a continuous change in the capacity of the pumping device.

10 Claims, 6 Drawing Sheets

VARIABLE CAPACITY COMPRESSOR WITH CAPACITY-INDICATING DEVICE

BACKGROUND OF THE INVENTION

This invention relates to a variable capacity compressor provided with a capacity-indicating device, and more particularly to a variable capacity compressor of this kind in which the capacity of the compressor is controlled by a control element rotatably arranged therein.

Recently, there has been a demand for a variable capacity compressor for an air conditioning system, which is provided with a device for visually indicating the compressor capacity so that the user of the compressor, such as the driver of an automotive vehicle in which the system in installed, can recognize the compressor capacity, and which is thus enhanced in commercial value.

To this end, a variable capacity compressor has been proposed, e.g. by Japanese Provisional Utility Model Publication (Kokai) No. 62-176010, which is provided with means for setting the compressor capacity at human will (e.g. a capacity-setting switch which is manually operated for setting the capacity of the compressor). According to the proposed compressor, the position of the means or setting switch humanly selected is sensed, and the sensed position of the switch, which represents the compressor capacity, is utilized as a signal for visually indicating the compressor capacity.

However, the position of the above capacity-setting switch merely indicates a level of the compressor capacity desired by the driver or the passenger who eperates the setting switch, but does not directly represent the capacity to which the compressor has been actually controlled. Further, the position of the capacity-setting switch is changed in a discontinuous manner, i.e. the switch can only be selectively set to a limited number of predetermined positions, so that it is impossible to indicate the change in the compressor capacity in a continuous or stepless manner.

Further, the above-described conventional technique can be applied only to a type of variable capacity compressor the capacity of which is adjusted from the outside (by humanly operating the capacity-setting switch). Therefore, it has been impossible to indicate the compressor capacity of a type of variable capacity compressor the capacity of which is automatically controlled in response to suction pressure of the compressor etc.

SUMMARY OF THE INVENTION

It is therefore the object of the invention to provide a variable capacity compressor the capacity of which is automatically controlled by a control element rotatably arranged therein and which visually indicates the capacity of the compressor in a continuous and direct manner to thereby enable the driver of an automotive vehicle in which the compressor is installed, or the like to accurately recognize the actual value of the compressor capacity.

According to the invention, there is provided a variable capacity compressor including pumping means, and a control element the position of which can be changed to determine the capacity of the pumping means, which comprises:

detector means for detecting change in the position of the control element in a continuous manner; and capacity-indicating means for visually indicating an output value thereof in a manner continuously variable in response to a continuous change in output from the detector means, whereby the output value visually indicated by the capacity-indicating means varies continuously with a continuous change in the capacity of the pumping means.

According to a preferred embodiment of the invention, there is provided a variable capacity vane compressor including a cylinder formed by a cam ring and a pair of side blocks respectively closing opposite ends of the cam ring, a rotor rotatably received within the cylinder, a plurality of vanes radially slidably fitted in slits formed in the rotor, and a control element disposed between the rotor and at least one of the side blocks for rotation about an axis thereof in opposite directions to change angular position thereof while sliding on one end faces of the rotor and the vanes, the capacity of the compressor being continuously variable in response to a continuous change in the rotational angular position of the control element, the compressor comprising:

angular position detecting means for detecting the angular position of the control element in a continuous manner;

capacity-indicating means for visually indicating an output value thereof in a manner continuously variable in response to a continuous change in output from the angular position detecting means, whereby the output value visually indicated by the capacity-indicating means varies continuously with a continuous change in the capacity of the compressor.

Preferably, the variable capacity vane compressor includes an outer wall enclosing the cylinder, rotor, vanes, and control element, the control element having a surface, and the angular position detecting means comprises:

a resistance element mounted on the surface of the control element in an electrically insulated manner and extending in a direction in which the control element is rotatable, the resistance element having one end electrically connected to the control element, and another end being electrically open;

a first probe disposed in slidable contact with the resistance element;

an earthing member disposed in slidable contact with the control element for grounding same;

a second probe extending through the outer wall and partially projected outwardly of the outer wall;

an electrically conductive member disposed within the compressor and electrically connected to the first probe, the second probe being in slidable contact with the electrically conductive member to electrically connect the first probe with the second probe;

means for applying a predetermined voltage to the first probe by way of the second probe and the electrically conductive member; and means outputting, as an output signal, a value of electric current flowing in the first probe corresponding to a point of the resistance element at which the first probe is in contact with the resistance element.

The above and other objects, features, and advantages of the invention will be more apparent from the ensuing detailed description taken in conjunction with the accompanying drawings.

DETAILED DESCRIPTION

Figure 1:
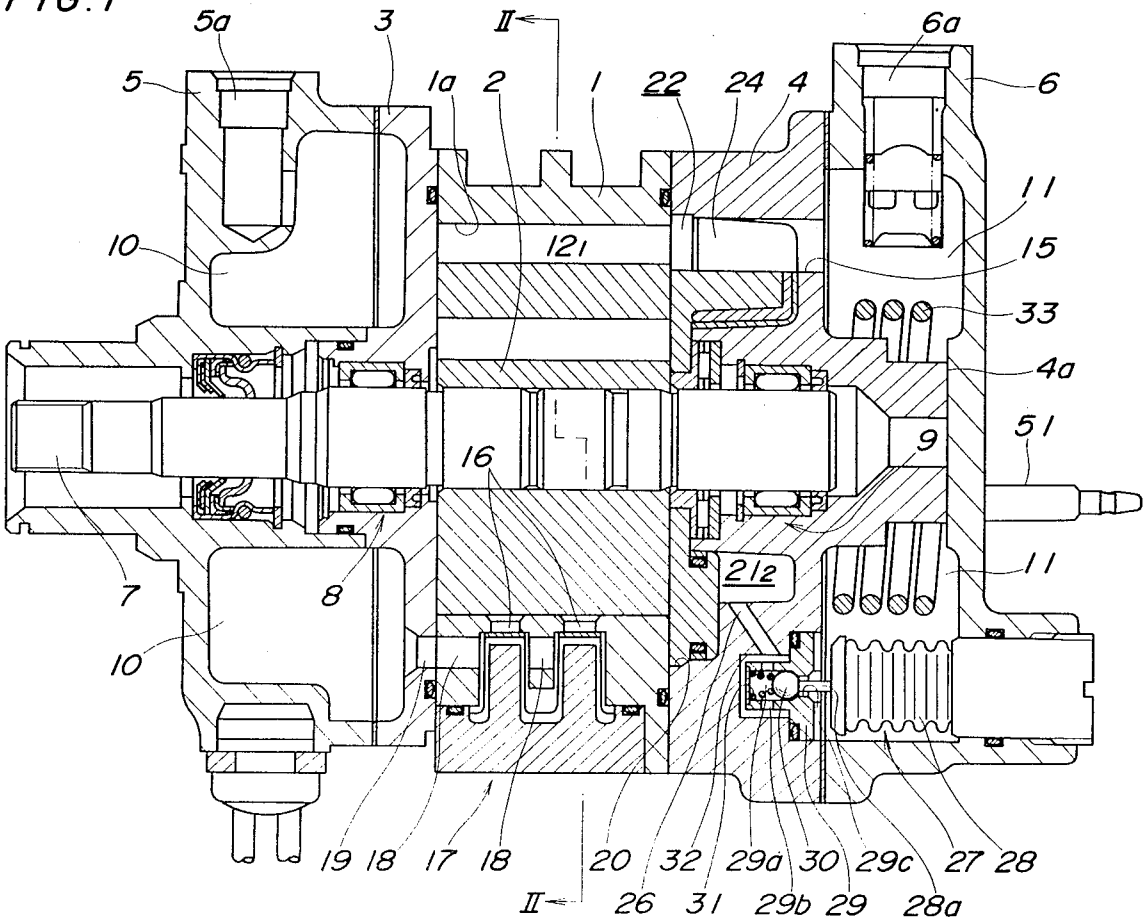
FIG. 1 is a longitudinal cross-sectional view of a variable capacity vane compressor with a capacity-indicating device according to the invention, taken along two planes containing the axis of a rotor thereof and lying at a predetermined angle, e.g. 45°, to each other.

The invention will now be described in detail with reference to the drawings showing embodiments thereof.

Referring first to FIGS. 1 through 5, there is illustrated a variable capacity compressor provided with a capacity-indicating device according to the invention, which is adapted for use in an air conditioning system for automotive vehicles.

The vane compressor according to the invention is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 fixed to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and ther front side block 3, and a suction chamber 11 defined by the rear head 6 and the rear side block 4.

Figure 2:
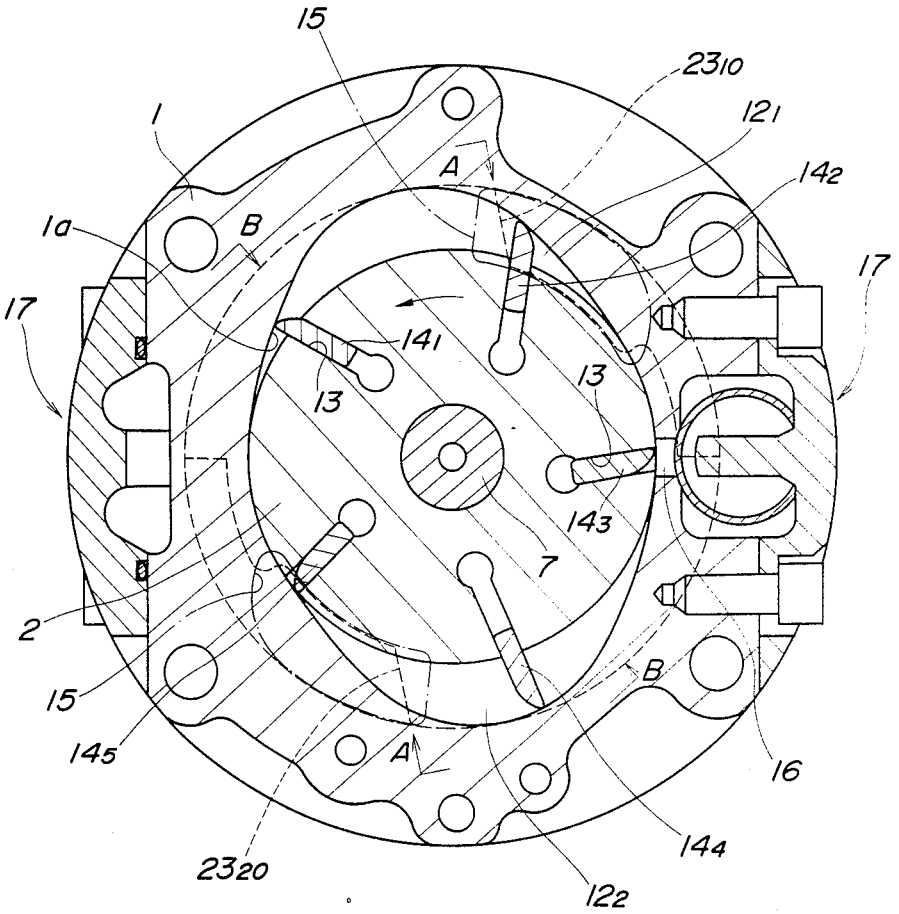
FIG. 2 is a transverse cross-sectional view taken along line II—II in FIG. 1.

As shown in FIG. 2, a pair of compression spaces $12_1$ and $12_2$ are defined at diametrically opposite locations between the inner peripheral surface 1*a* of the cam ring 1, the outer peripheral surface of the rotor, 2, an end face 3*a* of the front side block 3 on the cam ring side, and an end face 22*a* of a control element 22 on the cam ring side. The rotor 2 has its outer peripheral surface formed therein with a plurality of (five in the illustrated embodiment) axial vane slits 13 at circumferentially equal intervals, in each of which a vane $14_1$–$14_5$ is radially slidably fitted.

Refrigerant inlet ports 15 and 15 are formed in the rear side block 4 at diametrically opposite locations as shown by the dot and dash line in FIG. 2 (since FIG. 1 is taken along two planes containing the axis of the rotor and lying at an angle of 45° to each other, only one inlet port 15 is shown in the figure). These refrigerant inlet ports 15, 15 are located at such locations that they become closed when a chamber defined between successive two vanes of the vanes $14_1$–$14_5$ assume the maximum volume. These refrigerant inlet ports 15, 15 axially extend through the rear side block 4, and through which the suction chamber 11 and the compression spaces $12_1$ and $12_2$ are communicated with each other.

Refrigerant outlet ports 16, 16 are formed through opposite lateral side walls of the cam ring 1 as shown in FIGS. 1 and 2, each port having two openings. The cam ring 1 has opposite lateral side walls thereof provided with respective discharge valves 17, which open in response to discharge pressure to thereby open the refrigerant outlet ports 16, 16. Further formed in the cam ring 1 is a passage 18 which communicates with the refrigerant outlet ports 16, 16 when the discharge valve 17 opens. A passage 19 is formed in the front side block 3, which communicates with the passage 18, whereby when the discharge valve 17 opens to thereby open the refrigerant outlet port 16, a compressed refrigerant gas in the compression space 12 is discharged from the discharge port 5*a* via the refrigerant outlet port 16, the passages 18 and 19, and the discharge pressure chamber 10.

Figure 3:
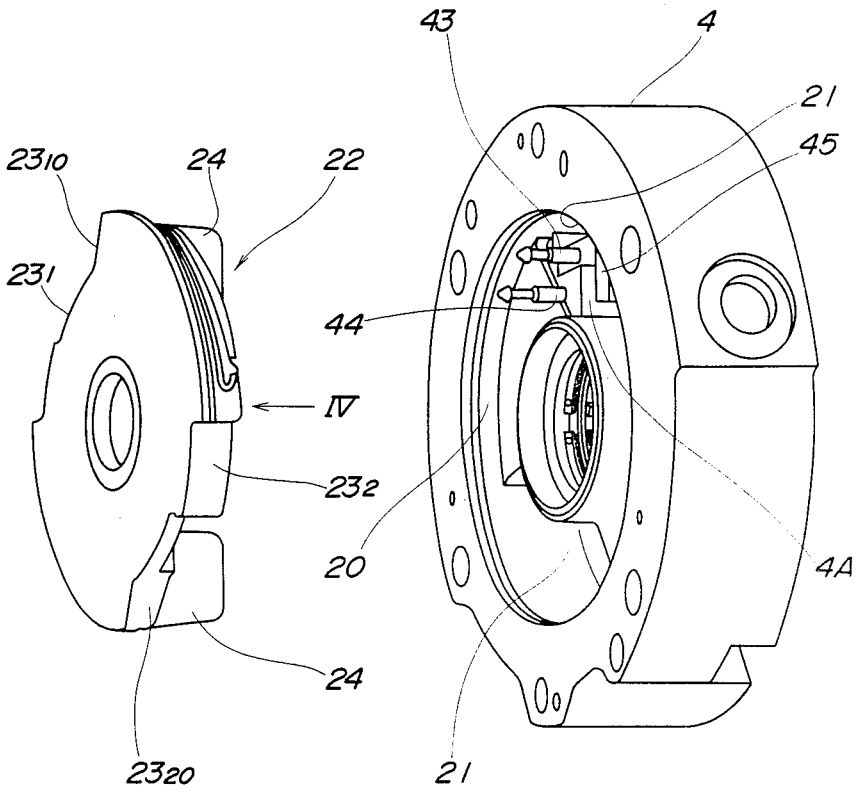
FIG. 3 is an exploded perspective view showing a control element and a rear side block, both appearing in FIG. 1, useful in explaining the manner of fitting the former into the latter.

As shown in FIG. 3, the rear side block 4 has an end face facing the rotor 2, in which is formed an annular recess 20. A pair of pressure working chambers 21 and 21 are formed in a bottom of the annular recess 20 at diametrically opposite locations, in a manner continuous with the respective refrigerant inlet ports 15 and 15.

Figure 4:
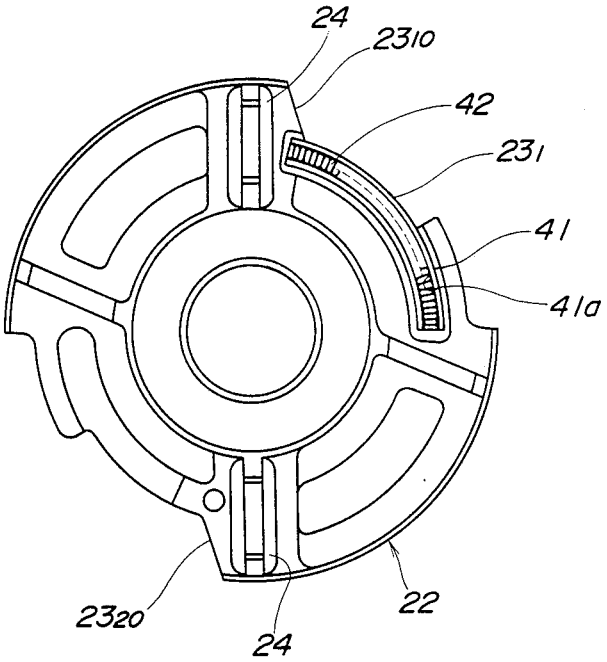
FIG. 4 is an end view of the control element as viewed in the direction of the arrow IV in FIG. 3.
Figure 5:
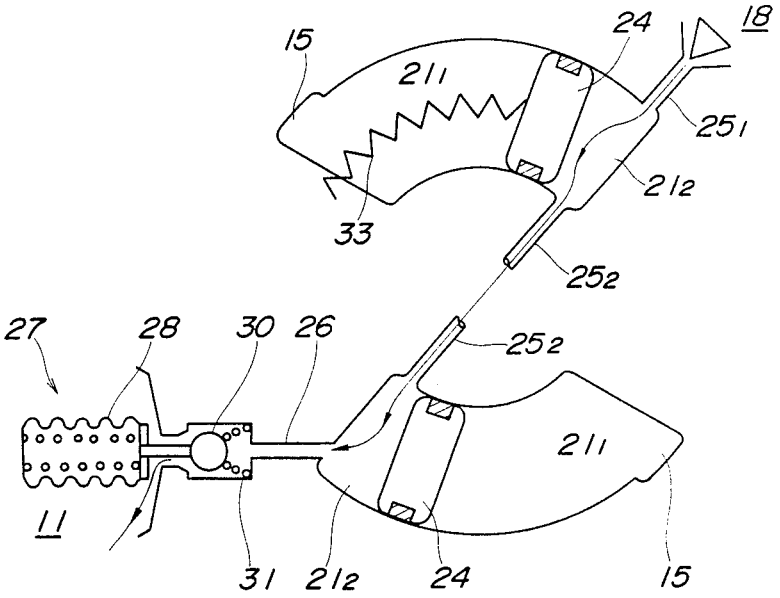
FIG. 5 is a diagrammatic view useful in explaining the manner of rotation of the control element of the compressor responsive to the difference in pressure between a first pressure chamber and a second pressure chamber.

The control element 22, which is in the form of an annulus as shown in FIGS. 3 and 4, is received in the annular recess 20 for rotation about its own axis in opposite circumferential directions as shown in FIG. 1. The control element 22 has its outer peripheral edge formed with a pair of diametrically opposite arcuate cut-out portions $23_1$ and $23_2$, and its one side surface formed integrally with a pair of diametrically opposite pressure-receiving protuberances 24 and 24 axially projected therefrom and acting as pressure-receiving elements. The pressure-receiving protuberances 24 and 24 are slidably received in the respective pressure working chambers 21 and 21. As shown in FIG. 5, the interior of each of the pressure working chambers 21 and 21 is divided into a first pressure chamber $21_1$ continuous with the corresponding refrigerant inlet port 15 and a second pressure chamber $21_2$ by the associated pressure-receiving protuberance 24. Each of the first pressure chambers $21_1$ and $21_1$ communicates with the suction chamber 11 through the corresponding inlet port 15, and one of the second pressure chambers $21_2$ and $21_2$ communicates with the passage 18 shown in FIG. 1 through a communication passage $25_1$. This one chamber $21_2$ is communicated with the other chamber $21_2$ by way of a communication passage $25_2$. The second pressure chambers $21_2$ and $21_2$ can be communicated with the suction chamber 11 through a passage 26 and a control valve device 27 provided within the rear side block 4 as shown in FIGS. 1 and 5. The control valve device 27 opens and closes the passage 26 in response to pressure within the suction chamber 17. When the valve of the control valve device 27 is open, pressure within the second pressure chambers $21_2$ and $21_2$ is allowed to leak into the suction chamber 11 through the passage 26. More specifically, as shown is FIGS. 1 and 5, the control valve device 27 comprises a flexible bellows 28, a valve casing 29, a ball valve body 30, and a coiled spring 31 urging the ball valve body 30 in its closing direction. The bellows 28 is disposed in the suction chamber 11, with its axis extending parallel with that of the driving shaft 7. When the suction pressure within the suction chamber 11 is above a predetermined value, the bellows 28 is in a contracted state, and when the suction pressure is below the predetermined value, the bellows 28 is in an expanded state. The valve casing 29 is fitted in a bore 32 which is formed in the rear side block 4 and communicated with the passage 26. The valve casing 29 has communication holes **29*b* and 29*c* formed respectively in an end wall and a side wall thereof, the communication holes 29*b* and 29*c* being communicated with each other through a hollow interior 29*a* of the valve casing 29. The ball valve body 30 is arranged in the hollow interior 29*a* to close and open the communication hole 29*c*. The coiled spring 31 is also arranged in the hollow interior 29*a* of the valve casing 29 and urges the ball valve body 30 in its closing direction. When the pressure within the suction chamber 11 is above the predetermined value, and therefore the bellows 28 is in a contracted state, the ball valve body 30 is urgedly biased in the valve-closing direction (rightward as viewed in FIG. 1) by the force of the coiled spring 31 to block the communication hole 29*c* of the valve casing 29, whereby the communication between the second pressure chambers $21_2$ and $21_2$ and the suction chamber 11 is cut off to maintain the pressure within the second pressure chambers $21_2$ and $21_2$ at a high level. When the pressure within the suction chamber 11 is below the predetermined value, and therefore the bellows 28 is in an expanded state, the ball valve body 30 is urgedly biased to open the communication hole 29*c* against the force of the coiled spring 31, by the expanded bellows 28 through a rod 28*a* secured thereto and loosely fitted through the communication hole 29*c*, whereby the high pressure within the second pressure chambers $21_2$ and $21_2$ is leaked to the suction chamber 11. In this way, the pressure within the second pressure chambers $21_2$ and $21_2$ is controlled by the control valve device 27 depending on whether the suction pressure is above the predetermined value or not. This controls the angular position of the control element 22** to maintain the suction pressure at a preset value based upon thermal load on the air conditioning system etc.

In the meanwhile, as shown in FIG. 1, the control element 22 is urged in the clockwise direction as viewed in FIG. 5 by a torsion coiled spring 33 fitted around a hub 4B of the rear side block 9 axially extending toward the suction chamber 11. The torsion coiled spring 33 has an end thereof engaged in an engaging hole, not shown, formed in an end face of the control element 22, and the other end is engaged in an engaging hole, not shown, formed in an end face of the hub 4B.

Thus the control element 22 is rotatable in opposite directions in response to the difference between the sum of the pressure within the first pressure chambers $21_1$ and $21_1$ and the urging force of the torsion coiled spring 33, and the pressure within the second pressure chambers $21_2$ and $21_2$. As the pressure within the second pressure chambers $21_2$ and $21_2$ is thus controlled by the control valve device 27 depending on whether the suction pressure is above the predetermined value or not, so as to maintain the suction pressure at a preset value, the control element 22 is rotated within a range between two extreme positions, i.e. the maximum capacity position in which leading ends $23_{10}$, $23_{20}$ of the cut-out portions of the control element are positioned at A in FIG. 2 to obtain the maximum capacity of the compressor, and the minimum capacity position in which the leading ends $23_{10}$, $23_{20}$ are positioned at B in FIG. 2 to obtain the minimum capacity of the compressor.

In operation of the compressor, low pressure or suction pressure within the suction chamber 11 is introduced into the first pressure chambers $21_1$, $21_1$ of the pressure working chambers 21, 21 through the respective refrigerant inlet ports 15, 15, whereas high pressure or discharge pressure within the passage 18 is introduced into the second pressure chambers $21_2$, $21_2$ of the pressure working chambers 21, 21 through the communication passage $25_1$ shown in FIG. 5. The control element 22 is circumferentially displaced in opposite directions between the maximum capacity position and the minimum capacity position depending upon the difference between the sum of the pressure within the first pressure chambers $21_1$ and the biasing force of the torsion coiled spring 31 (which acts upon the control element 22 so as to urge same toward the minimum capacity position B, i.e. in the counter-clockwise direction as viewed in FIG. 2) and the pressure within the second pressure chamber $21_2$ (which acts upon the control element 22 so as to urge same toward the maximum capacity position A, i.e. in the clockwise direction as viewed in FIG. 2).

More specifically, the above-described angular displacement of the control element responsive to change in the suction pressure causes the leading ends $23_{10}$, $23_{20}$ of the cut-out portions of the control element 22 to be steplessly shifted between the position A in FIG. 2, the most backward position in the direction of rotation of the rotor 2 (in the counterclockwise direction as viewed in FIG. 2), and the position B in FIG. 2, the most forward position in the same direction. In accordance with this shift in position of the leading ends $23_{10}$, $23_{20}$, the starting time of the compression stroke of the compressor is varied, whereby the capacity of the compressor is steplessly or continuously varied.

Next, the capacity-indicating device which visually indicates the capacity of the variable capacity compressor constructed as above will be described with reference to FIGS. 2, 4, and 6 to 10.

As described above, the capacity of the compressor is a function of the rotational angle or angular position of the control element 22. The principle of the capacity-indicating device according to the invention is based upon the functional relationship between the rotational angle of the control element 22 and the capacity of the compressor. The device detects the rotational angle of the control element, converts the detected rotational angle into the capacity of the compressor, and visually indicates same.

Details of the construction and operation of the capacity-indicating device will be described below.

Figure 11:
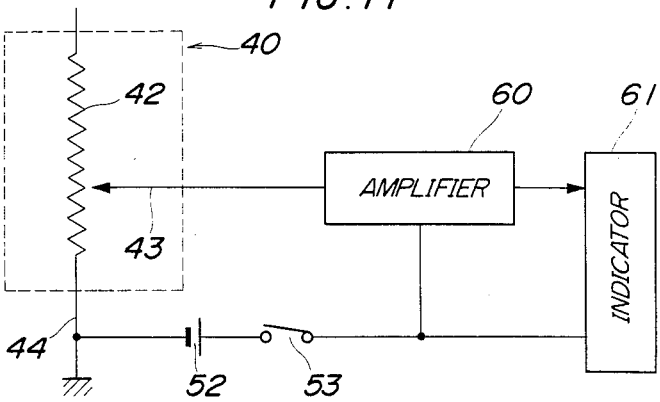
FIG. 11 is a circuit diagram of an example of an electrical circuit of the capacity-indicating device according to the invention.

As shown in FIG. 11, the capacity-indicating device comprises a current detector 40 which produces an electrical signal indicative of the rotational angle of the control element 22, an amplifier 60 which amplifies the output current of the current detector, and an indicator 61 which visually indicates the output current amplified by the amplifier 60 in a predetermined manner (digital indication, analog indication, etc.).

Figure 6:
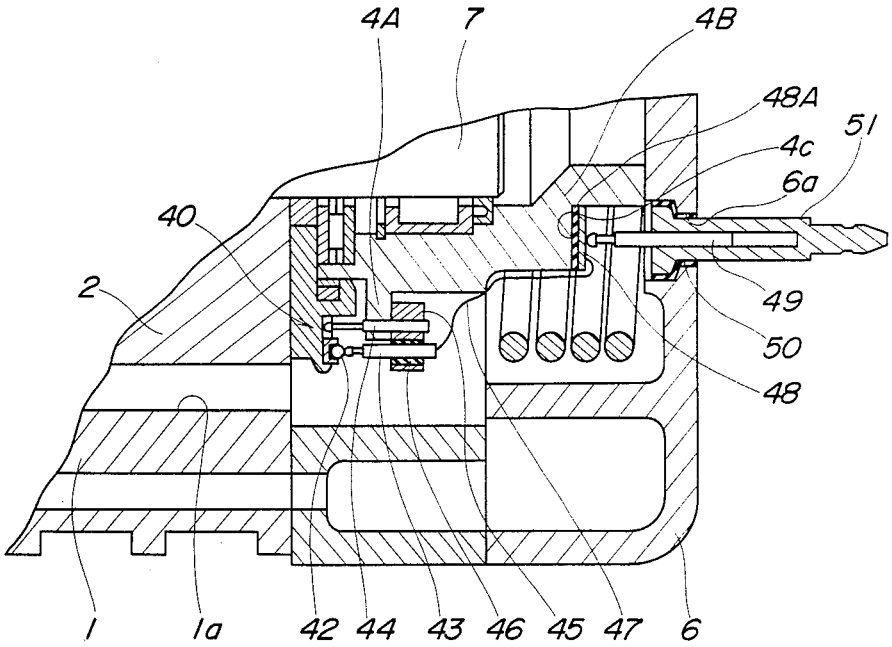
FIG. 6 is a fragmentary sectional view of the compressor showing essential parts thereof including a current detector of the capacity-indicating device.
Figure 7:
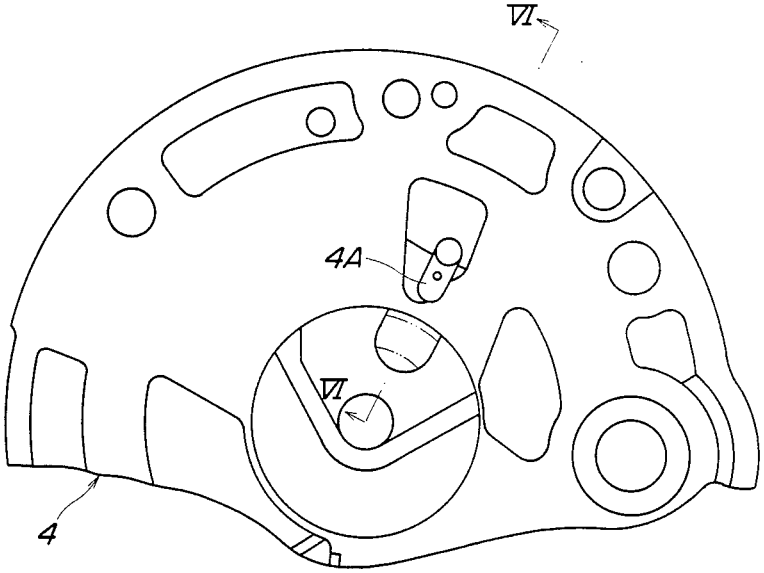
FIG. 7 is a fragmentary end view of the rear side block in FIG. 1 taken from a side thereof remote from a rotor.
Figure 8:
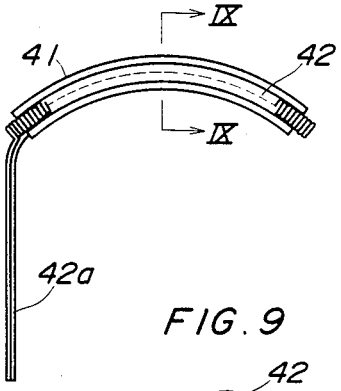
FIG. 8 is an end view of the control element in FIG. 1 showing a resistance wire mounted thereon.
Figure 10:
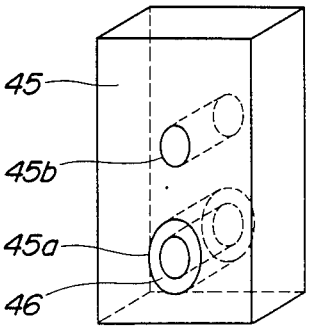
FIG. 10 is a perspective view of a holder in FIG. 6.
Figure 9:
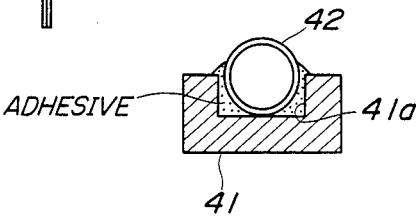
FIG. 9 is a transverse cross-sectional view taken along line IX—IX in FIG. 8.

More specifically, the current detector 40 comprised, as shown in FIGS. 4 and 6, a resistance wire 42 mounted on the control element 22, a first probe 43 disposed in slidable contact with the resistance wire 42 for detecting the output current, and an earthing member 44 disposed in slidable contact with the control element 22 and electrically connected to the main body (rear side block 4) of the compressor for grounding same. The resistance wire 42 is rigidly fitted in a channel groove 41*a* formed in an outer surface of an arcuate seat member 41 attached to an end face of the control element 22 remote from the rotor 1 and circumferentially extending along about one fourth of the whole circumference thereof. The resistance wire 42 is stuck to the channel groove 41*a* by an adhesive or like means. One end of the resistance wire 42 is connected to the control element 22 and hence virtually grounded via the earthing member 44, and the other end thereof is free, i.e. electrically open. The first probe 43 and the earthing member 44 supportedly extend through a first fitting hole 45*a* of a holder 45 and a second fitting hole 45*b* of same, respectively (as shown in FIGS. 3, 6 and 10). The holder 45 is rigidly secured by an adhesive to an end face of a projection 4A of the rear side block 4 facing toward the rear head 6. An insulator 46 is interposed between the first probe 43 and the holder 45 to insulate the first probe 43 from the main body of the compressor. In the meanwhile, the earthing member 44 extends not only through the holder 45 but also through the projected part 4A of the rear side block 4, whereby the earthing member 44 and the rear side block 4 (the main body of the compressor) are electrically connected to each other.

Further, the first probe 43 has a lead 47 extending therefrom and connected to an electrically conductive plate (copper plate) 48 which is attached to a recessed portion 4C of the hub 4B of the rear side block 4 with an insulator 48A interposed therebetween. A second probe 49 is disposed in slidable contact with the electrically conductive plate 48 and hence electrically connected thereto. The second probe 49 is fitted in a terminal member 51 which is fitted in a fitting hole 6*a* of the rear head 6 formed through a rear end wall thereof at a location opposed to the electrically conductive plate 48, with an insulator 50 interposed therebetween.

Figure 13:
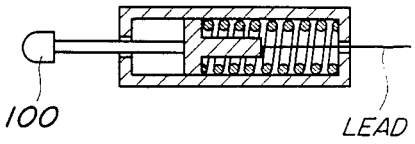
FIG. 13 is an transverse cross-sectional view of a probe of the capacity-indicating device.

As shown in FIG 13, the first and second probes and the earthing member are all a spring-biased type in which a spring provided therein urges a sliding tip 100 against the associated element (the resistance wire 42, the control element 22, or the electrically conductive plate 48).

As shown in the electrical circuit of FIG. 11, the capacity-indicating device of the invention utilizes the electrical output from the resistance wire 42 as a signal indicative of the rotational angle of the control element 22. The first probe 43 is connected to an input side of the current amplifier 60 which has a feeding terminal, not shown, to which is connected a battery 52 by way of a switch 53 (e.g. an ignition switch in the case where the compressor is driven by an engine of the automotive vehicle). More advantageously, the output from the battery 52 may be regulated to a constant voltage by a suitable voltage regulator, not shown. The amplifier 60 has its output side connected to an input side of the indicator or display 61. When the switch 53 is closed, the output voltage from the battery 52 is applied via the closed switch 53 to the amplifier 60, and then leakage current flows from the input side of the amplifier 60 and is applied to the resistance wire 43 through the first probe 43. Change in the position of the first probe 43 on the resistance wire 42 responsive to the rotation of the control element 22 causes the effective resistance value of the resistance wire 42 to be changed. In other words, the effective resistance value of the resistance wire 42 varies with a change in the rotational angle of the control element 22. Therefore, when the switch 53 is closed and a predetermined voltage from the amplifier 60 is applied to the resistance wire 42 by way of the first probe 43, the value of electric current which flows from the amplifier 60 through the first probe 43 and the resistance wire 42 to the ground varies with a change in the rotational angle of the control element 22. This variation in electric current is amplified by the amplifier 60 and delivered to the indicator 61, which in turn visually indicates the output from the amplifier 60 in terms of the rotational angle of the control element 22, in a suitable manner (e.g. digitally, or by the use of a pointer).

By virtue of the above-described construction according to the invention, in electrically detecting the rotational angle of the control element 22 arranged within the compressor from change in the sliding position of the first probe 43 on the resistance wire 42, the first probe 43 serves not only as means for detecting or picking up electric current corresponding to the sliding position thereof, but also as means for applying a predetermined voltage to the resistance wire 42. In other words, since a single electrical path (through the second probe, the electrically conductive plate, and the first probe) has the above-mentioned two functions, it is unnecessary to provide an additional electrical path for applying a predetermined voltage to the resistance wire 42 from the battery 52. Therefore, this arrangement is particularly advantageous to a compressor, which has a markedly great difference in pressure between the inside and outside thereof, and accordingly necessitates isolating the inside from the outside.

According to the embodiment described above, the rotational angle of the control element 22 is indicated by the indicator 61 by utilizing the fact that the rotational angle of the control element 22 is in a predetermined relationship to the resistance value of the resistance wire 42 which is determined in accordance with the position of the first probe 43. However, more advantageously the indicator 61 may be designed to directly indicate the capacity of the compressor by determining in advance the predetermined relationship between the capacity of the compressor and the rotational angle of the control element 22 based on the profile of the cam surface of the cylinder 1 etc.

Figure 12:
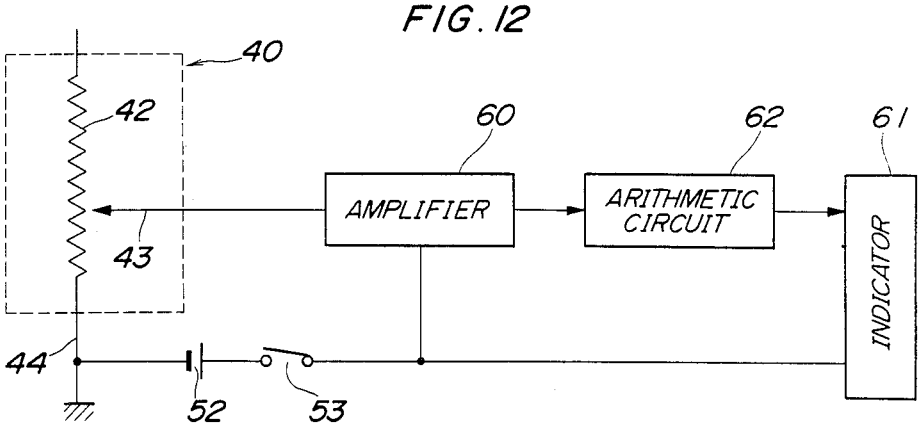
FIG. 12 is a circuit diagram of another example of the electrical circuit in which an arithmetic circuit is connected to the output of an amplifier.

Further, in the case of a compressor in which the rotational angle of the control element 22 is not directly proportional to the capacity of the compressor, it is difficult, if the indicator 61 uses a pointer, to accurately recognize a variation in the capacity through observation of change in the position of the pointer alone. To overcome this, as shown in FIG. 12, for example, an arithmetic circuit 62 may be connected to the output of the amplifier 60, which modulates the output from the amplifier 60 and generates an output which is directly proportional to the rotational angle of the control element 22, whereby the capacity of the compressor can be indicated by the pointer with a scale which is graduated at regular intervals, each interval representing a given or identical value of the capacity difference of the compressor.

Although in the above-described embodiment, the first probe 43 is arranged to extend in a direction perpendicular to the plane of rotation of the control element 22, alternatively it may be arranged to extend in a direction parallel to the plane of rotation of same.

Further, although in the above-described embodiment, the capacity-indicating device is applied to a vane compressor, the invention is not limited to this but may be applied to any other pump means in which the position of a control element is varied relative to the capacity thereof in a predetermined relationship.

What is claimed is:

1. A variable capacity compressor including pumping means, a suction chamber for supplying said pump means with low pressure, a discharge pressure chamber supplied with high pressure from said pumping means, and a control element the position of which changes in response to a difference between low pressure from said suction chamber and high pressure from said discharge pressure chamber to determine the capacity of said pumping means, which comprises:

detector means for detecting change in the position of said control element in a continuous manner and having an output commensurate with said change; and capacity-indicating means for visually indicating an output value thereof in a manner continuously variable in response to a continuous change in said detector means output, whereby the output value visually indicated by said capacity-indicating means varies continuously with a continuous change in the capacity of said pumping means.

2. A variable capacity compressor including pumping means, and a control element the position of which can be changed to determine the capacity of said pumping means, wherein said control element has a surface;

which comprises:

detector means for detecting change in the position of said control element in a continuous manner; and capacity-indicating means for visually indicating an output value thereof in a manner continuously variable in response to a continuous change in output from said detector means, whereby the output value visually indicated by said capacity-indicating means varies continuously with a continuous change in the capacity of said pumping means;

said detector means comprising;

a resistance element mounted on said surface of said control element in an electrically insulated manner and extending in a direction in which said control element is displaceable, said resistance element having one end electrically connected to said control element, and another end being electrically open;

a probe disposed in slidable contact with said resistance element;

an earthing member disposed in slidable contact with said control element for grounding same;

means for applying a predetermined voltage to said probe; and means for outputting, as an output signal, a value of electric current flowing in said probe corresponding to a point of said resistance element at which said probe is in contact with said resistance element.

3. A variable capacity vane compressor including a cylinder formed by a cam ring and a pair of side blocks respectively closing opposite ends of said cam ring, a rotor rotatable received within said cylinder, a plurality of vanes radially slidably fitted in slits formed in said rotor, a suction chamber for supplying low pressure within said cylinder, a discharge pressure chamber supplied with high pressure from said cylinder, and a control element disposed between said rotor and at least one of said side blocks for rotation about an axis thereof in opposite directions to change angular position thereof while sliding on one end face of said rotor and said vanes, said control element being rotatable in response to a difference between low pressure from said suction pressure and high pressure from said discharge pressure chamber, the capacity of said compressor being continuously variable in response to a continuous change in the rotational angular position of said control element, said compressor comprising:

angular position detecting means for detecting the angular position of said control element in a continuous manner; and capacity-indicating means for visually indicating an output value thereof in a manner continuously variable in response to a continuous change in output from said angular position detecting means, whereby the output value visually indicated by said capacity-indicating means varies continuously with a continuous change in the capacity of said compressor.

4. A variable capacity vane compressor as claimed in claim 3, further including an arithmetic circuit connected between said angular position detecting means and said capacity-indicating means for modulating output from said detecting means and generating output which is directly proportional to the angular position of said control element, whereby the capacity of said compressor can be indicated with a scale which is graduated at regular intervals, each of said regular intervals representing a given or identical value of capacity difference of said compressor.

5. A variable capacity vane compressor including a cylinder formed by a cam ring and a pair of side blocks respectively closing opposite ends of said cam ring, a rotor rotatably received within said cylinder, a plurality of vanes radially slidably fitted in slits formed in said rotor, and a control element disposed between said rotor and at least one of said side blocks for rotation about an axis thereof in opposite directions to change angular position thereof while sliding on one end faces of said rotor and said vanes, the capacity of said compressor being continuously variable in response to a continuous change in the rotational angular position of said control element, an outer wall enclosing said cylinder, rotor, vanes, and control element, said control element having a surface, said compressor comprising:

angular position detecting means for detecting the angular position of said control element in a continuous manner;

capacity-indicating means for visually indicating an output value thereof in a manner continuously variable in response to a continuous change in output from said angular position detecting means, whereby the output value visually indicated by said capacity-indicating means varies continuously with a continuous change in the capacity of said compressor;

said angular position detecting means comprising:

a resistance element mounted on said surface of said control element in an electrically insulated manner and extending in a direction in which said control element is rotatable, said resistance element having one end electrically connected to said control element, and another end being electrically open;

a first probe disposed in slidable contact with said resistance element;

an earthing member disposed in slidable contact with said control element for grounding same;

a second probe extending through said outer wall and partially projected outwardly of said outer wall;

an electrically conductive member disposed within said compressor and electrically connected to said first probe, said second probe being in slidable contact with said electrically conductive member to electrically connect said first probe with said second probe;

means for applying a predetermined voltage to said first probe by way of said second probe and said electrically conductive member; and means outputting, as an output signal, a value of electric current flowing in said first probe corresponding to a point of said resistance element at which said first probe is in contact with said resistance element.

6. A variable capacity vane compressor as claimed in claim 5, wherein said resistance element is disposed on an end face of said control element remote from said rotor.

7. A variable capacity vane compressor as claimed in claim 5, wherein said electrically conductive member is mounted on said at least one of said side blocks, said second probe extending through a fitting hole formed in said outer wall at a location opposed to said electrically conductive member.

8. A variable capacity vane compressor as claimed in claim 5, wherein said at least one of said side blocks has a holder directly mounted thereon, said earthing member being directly supported by said holder to be electrically connected to said at least one of said side blocks, said first probe being supported by said holder in a manner electrically insulated from said at least one of said side blocks.

9. A variable capacity vane compressor as claimed in claim 8, wherein said at least one of said side blocks has a projection formed thereon and opposed to said control element, said holder being mounted on said projection.

10. A variable capacity vane compressor as claimed in, claims 5, 8 and 7, wherein each of earthing member comprises a sliding member and a spring urging said sliding member toward an associated one of said resistance element, control element, and electrically conductive member.

* * * * *